US005219693A

United States Patent [19]

Akao et al.

[11] Patent Number: 5,219,693

[45] Date of Patent: Jun. 15, 1993

[54] PRINTING PLATE FOR ELECTROPHOTOGRAPHIC PROCESS COMPRISING TRISAZO INCORPORATED IN AN ALKALI-SOLUBLE RESIN BINDER

[75] Inventors: Akio Akao, Sagamihara; Seiji Kuwakubo, Fussa; Takao Soma, Sagamihara; Takeo Kadoi, Tokyo, all of Japan

[73] Assignee: Iwatsu Electric Co., Ltd., Tokyo, Japan

[21] Appl. No.: 605,262

[22] Filed: Oct. 29, 1990

[30] Foreign Application Priority Data

Nov. 2, 1989 [JP] Japan ..... 1-284965

[51] Int. Cl.[5] ..... G03G 5/06

[52] U.S. Cl. ..... 430/72; 430/74; 430/76; 430/96

[58] Field of Search ..... 430/49, 72, 76, 74, 430/96

[56] References Cited

U.S. PATENT DOCUMENTS

| | | | |
|---|---|---|---|
| 4,426,432 | 1/1984 | Sawada et al. | 430/76 |
| 4,433,039 | 2/1984 | Miyakawa et al. | 430/76 |
| 4,839,252 | 6/1989 | Murata et al. | 430/74 |
| 4,859,555 | 8/1989 | Nishio et al. | 430/76 |
| 4,868,079 | 9/1989 | Khe et al. | 430/74 |

FOREIGN PATENT DOCUMENTS

| | | | |
|---|---|---|---|
| 3216738 | 11/1982 | Fed. Rep. of Germany . | |
| 3227475 | 2/1983 | Fed. Rep. of Germany . | |
| 3417951 | 11/1985 | Fed. Rep. of Germany . | |
| 3911405 | 10/1989 | Fed. Rep. of Germany . | |
| 1-109354 | 4/1989 | Japan | 430/72 |

*Primary Examiner*—Marion E. McCamish
*Assistant Examiner*—Christopher D. RoDee
*Attorney, Agent, or Firm*—Paul & Paul

[57] ABSTRACT

Disclosed is a printing plate, for an electrophotographic process, which comprises an electroconductive support and a photosensitive layer formed on the electroconductive support, in which the photosensitive layer is formed by incorporating (a) a trisazo pigment represented by the general formula (I) and (b) at least one member selected from perynone pigments and anthanthrone pigments as photoconductive substances and (c) at least one electron donor substance as a sensitizer in an alkali-soluble binder resin. This printing plate has a high sensitivity and a printing image having a high quality is formed on the printing plate without contamination of the non-image area due to the electrophotography, and prints having a high-quality image can be obtained by using this printing plate.

15 Claims, No Drawings

PRINTING PLATE FOR ELECTROPHOTOGRAPHIC PROCESS COMPRISING TRISAZO INCORPORATED IN AN ALKALI-SOLUBLE RESIN BINDER

BACKGROUND OF THE INVENTION (1) Field of the Invention

The present invention relates to a printing plate which can be made by the electrophotographic process. More particularly, the present invention relates to a novel printing plate comprising a negatively charged electrophotographic photosensitive material having a sensitivity to a white light, gas laser or light-emitting diode as the light source, which is made by forming a toner image through a series of steps of the electrophotographic process and eluting the photosensitive layer of a non-image area.

(2) Description of the Related Art

A positive type PS plate comprising a diazo compound and formed by utilizing photodisintegration, and a negative type PS plate comprising an acrylic prepolymer and formed by utilizing photocuring are practically used as a planographic printing plate, but since the sensitivity of these plates is low, an original is prepared by using a silver salt film and the light exposure is carried out while the original is closely adhered to the plate material. Accordingly, the plate-making process is complicated and completion of the plate-making process takes a long time, and these printing plates are unsatisfactory in that the manufacturing cost is too high.

A known zinc oxide/resin dispersion type printing plate (zinc oxide master paper) is a high-sensitivity printing plate formed by utilizing the electrophotographic process. In this technique, a planographic printing plate is made by irradiating an original with light, exposing a plate-forming material to reflected light obtained by the irradiation, to form an electrostatic latent image, and reproducing the latent image by a developing agent. Furthermore, if an aqueous solution comprising a ferrocyanide or phytic acid as the main component (so-called etching solution) is used for the surface treatment, to render the non-image area hydrophilic, a planographic printing becomes possible. This process is called a direct plate-making process and is advantageous in that, since the plate-making process is simple, the plate-making time can be shortened and the running costs are low. Nevertheless, this process is unsatisfactory in that the printing durability of the formed printing plate is lower than 10,000 prints, and that the range of printing conditions (the kinds of ink, etching solution and wetting water that can be used) is narrow. Moreover, although the zinc oxide/resin dispersion printing plate has a sensitivity to the visible rays of a halogen lamp, it does not show a practically applicable sensitivity to the long-wavelength rays of an He-Ne laser or light-emitting diode.

SUMMARY OF THE INVENTION

A primary object of the present invention is to provide a printing plate for the electrophotographic process, which printing plate has a high sensitivity and provides a high-grade printed image without contamination by a non-image area.

Another object of the present invention is to provide a printing plate for the electrophotographic process during which a recording can be made by using a light source such as a halogen lamp, an He-Ne laser or a light-emitting diode.

Still another object of the present invention is to provide a printing plate having an good stability over a lapse of time.

As a result of an investigations by the present inventors, it was found that the foregoing objects can be attained by a printing plate for the electrophotographic process, which printing plate comprises a photosensitive layer formed on an electroconductive support, the photosensitive layer comprising an alkali-soluble binder resin, and incorporated therein, (a) a triazo pigment represented by the following general formula (I):

$$A-N=N-Ar_1-N=N-Ar_2-N=N-A \quad (I)$$

wherein A represents a coupler residue having an aromatic property, more specifically, a coupler residue represented by the following general formula (a):

(a)

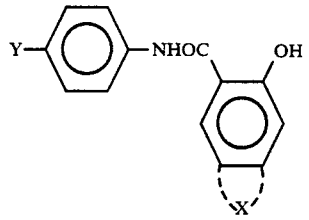

in which X represents a residue capable of forming a naphthalene ring, an anthracene ring or a carbazole ring by fusion to the benzene ring, and Y is selected from H, Cl, and $CH_3$, and $Ar_1$ and $Ar_2$ each represent a substituted or unsubstituted carbocyclic aromatic ring group, and (b) at least one member selected from the group consisting of perynone pigments and anthanthrone pigments as photoconductive substances, and (c) at least one electron donor substance as a sensitizer.

DESCRIPTION OF THE PREFERRED EMBODIMENTS

As typical examples of the trisazo pigment of general formula (A) to be used in the present invention, the following compounds are mentioned:

(A-1)
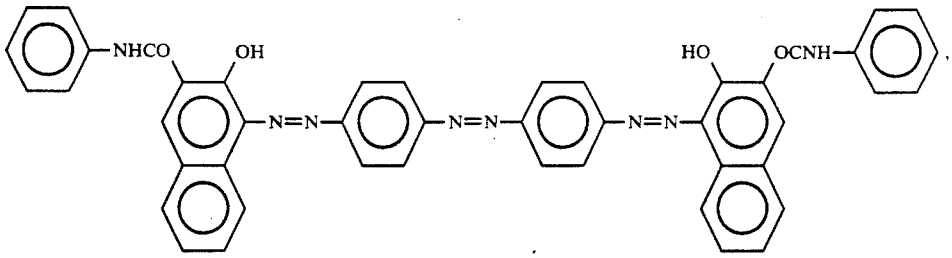
(A-2)
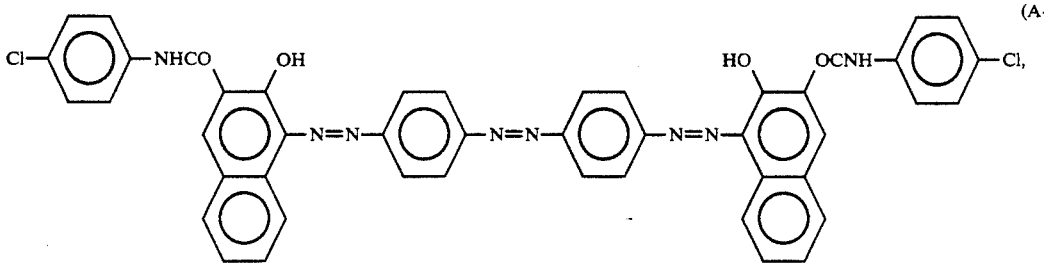
(A-3)
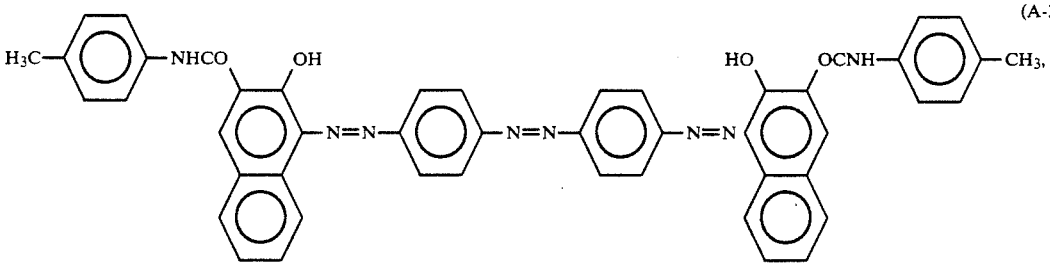
(B-1)
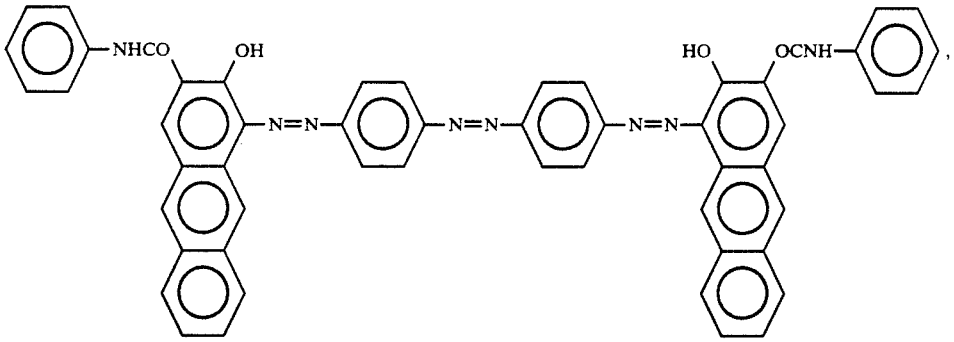
(B-2)
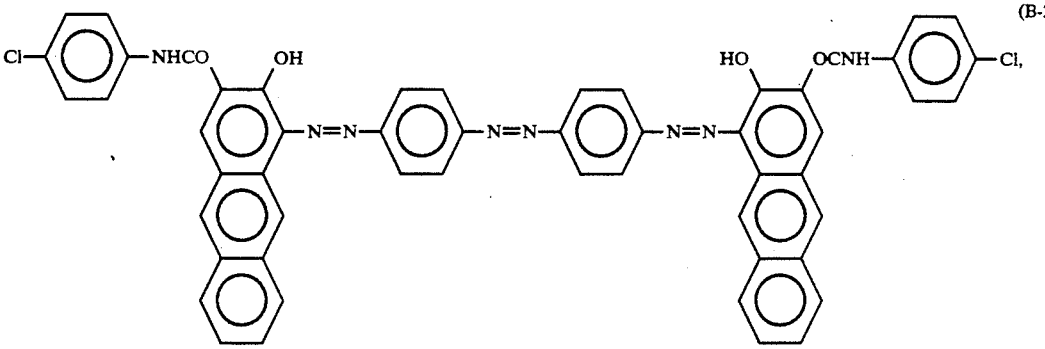

-continued
(B-3)
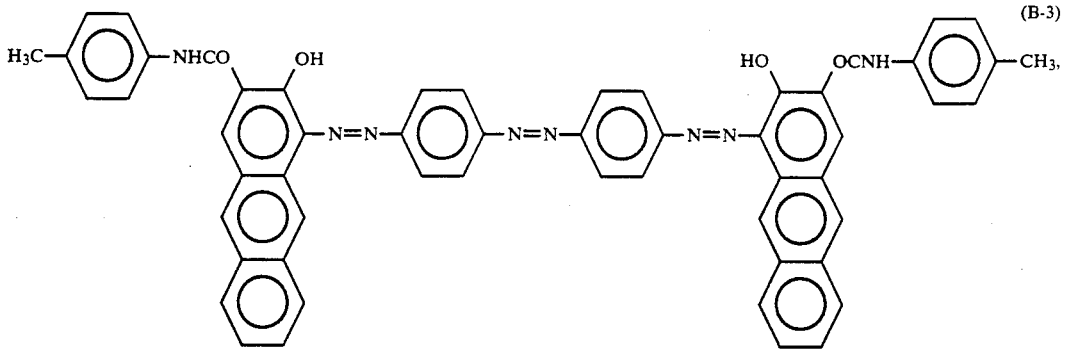
(C-1)
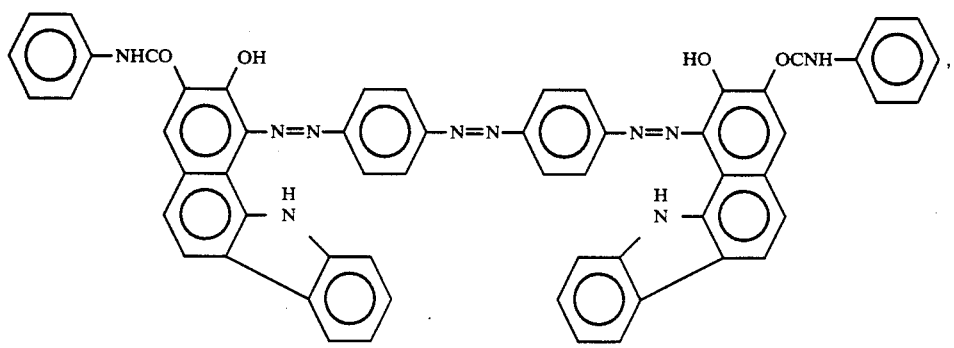
(C-2)
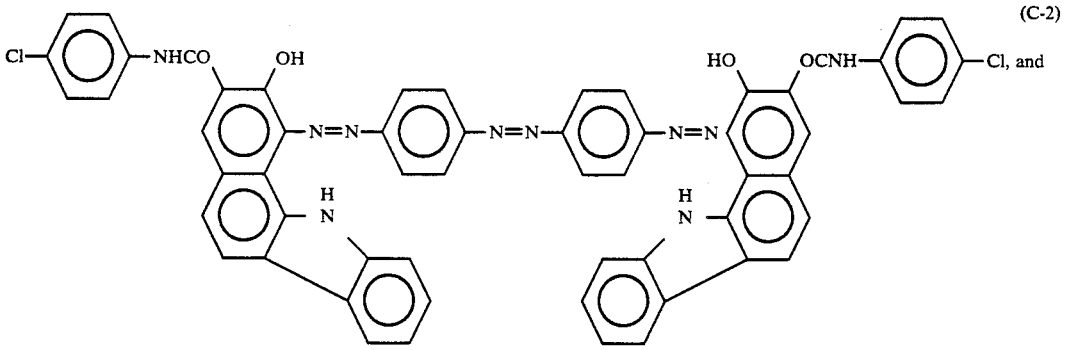
(C-3)
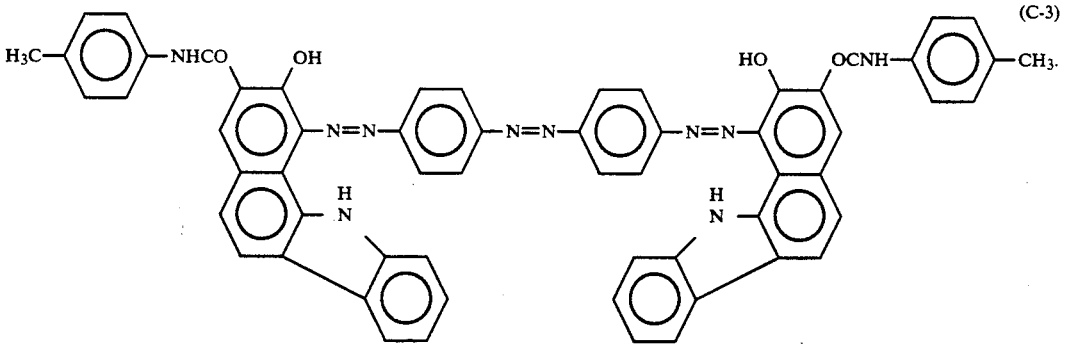
(IV)
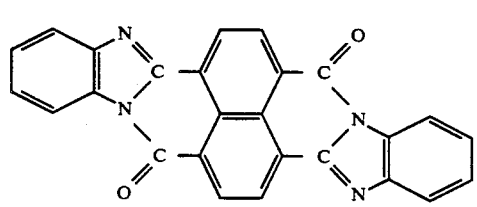
The perynone pigment used in the present invention is represented by the following formula:

The anthanthrone pigment used in the present invention is represented by the following formula:

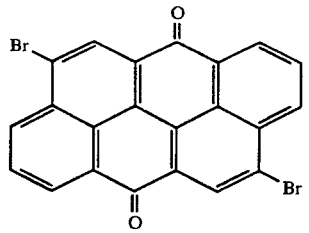

(V)

An electron donor substance can be incorporated in the printing plate of the present invention, to improve the electrophotographic characteristics, mainly the sensitivity, and as the electron donor substance, there can be mentioned, for example, oxadiazole compounds such as 2,5-bis(4-dimethylaminophenyl)-1,3,4-oxadiazole, 2,5-bis(4-diethylaminophenyl)-1,3,4-oxadiazole and 2,5-bis[4-(4-diethylaminostyryl)phenyl]-1,3,4-oxadiazole, oxazole compounds such as 2-vinyl-4-(2-chlorophenyl)-5-(4-diethylamino)oxazole and 2-(4- diethylaminophenyl)-4-phenyloxazole, triphenylmethane compounds such as 2,2'-dimethyl-4,4'-bis(diethylamino)triphenylmethane and tris(4-diethylaminophenyl)methane, hydrazone compounds such as 9-ethylcarbazole-3-aldehydo-1-methyl-1-phenylhydrazone, 9-ethylcarbazole-3-aldehydo-1-benzyl-1-phenylhydrazone, 4-diethylaminobenzaldehydo-1,1-diphenylhydrazone and 2-methyl-4-dibenzylaminobenzaldehydro-1,1-diphenylhydrazone, dialkylaminobenzoic acids such as dimethylaminobenzoic acid, diethylaminobenzoic acid and dipropylaminobenzoic acid, and polycyclic aromatic compounds such as fluorene, pyrene and perylene.

An alkali-soluble resin or an alcohol-soluble resin is used as the binder in the printing plate of the present invention, so that the photosensitive layer can be easily eluted with an aqueous solution of an alkali or a mixture thereof with an alcohol. The selected binder must have not only an alkali solubility or an alcohol solubility but also excellent electric characteristics when formed into an electrophotographic photosensitive material, a mechanical strength high enough to provide a good printing durability to a printing plate, and a satisfactory ink resistance. As a resin having such properties, there can be mentioned resins having a hydroxyl group or a carboxyl group. For example, the following resins can be used.

(1) Copolymers of acrylic acid (or methacrylic acid) with at least one member selected from methacrylic acid esters (such as methyl methacrylate, butyl methacrylate, 2-ethylhexyl methacrylate, dodecyl methacrylate and stearyl methacrylate).

(2) Copolymers of at least one member selected from vinyl esters (such as vinyl acetate, vinyl butyrate and vinyl propionate) with an unsaturated carboxylic acid (such as crotonic acid, itaconic acid, citraconic acid, maleic acid or maleic anhydride).

(3) Copolymers of styrene with maleic acid or maleic anhydride.

(4) Novolak type phenolic resins obtained by condensation reaction of at least one member selected from phenol and substituted phenols such as o-cresol-m-cresol, p-cresol, t-butylphenol, cyclohexylphenol, t-butylcresol and cyclohexylcresol with an aldehyde such as formaldehyde, acetaldehyde, acrolein or crotonaldehyde under acidic conditions.

(5) Mixtures of two or more of the foregoing resins.

As the electroconductive support, there can be used electroconductive supports having a hydrophilic surface, for example, an aluminum sheet, a zinc sheet, bimetal sheets such as a copper/aluminum sheet, a copper/stainless steel sheet and a chromium/copper sheet, and trimetal sheets such as a chromium/copper/aluminum sheet, a chromium/lead/iron sheet and a chromium/copper/stainless steel sheet. The thickness of the electroconductive support is preferably 0.1 to 1 mm.

In the case of a support having an aluminum surface, preferably the support is subjected to a surface treatment such as a sandblasting treatment, an immersion treatment in an aqueous solution of sodium silicate, sodium fluoride, potassium fluorozirconate or a phosphoric acid salt, or an anodizing treatment. Furthermore, preferably an aluminum sheet which has been subjected to a sandblasting treatment and then to an immersion treatment in an aqueous solution of sodium silicate, as disclosed in the specification of U.S. Pat. No. 2,714,066, and an aluminum sheet which has been subjected to an anodizing treatment and then to an immersion treatment in an aqueous solution of an alkali metal silicate, as disclosed in Japanese Unexamined Patent Publication No. 47-5125, are used.

The anodizing treatment is carried out by applying an electric current to an aluminum plate as the anode in an electrolyte such as a solution of an inorganic acid such as phosphoric acid, chromic acid, sulfuric acid or boric acid, an organic acid such as oxalic acid or sulfamic acid, or a salt thereof.

In the present invention, to improve the adhesive force between the support and the electrophotographic photosensitive layer, and to improve the electrostatic characteristics of the electrophotographic photosensitive layer, an alkali-soluble intermediate layer composed of casein, polyvinyl alcohol, ethyl cellulose, a phenolic resin, a styrene/maleic anhydride copolymer or polyacrylic acid can be interposed between the electroconductive support and the electrophotographic photosensitive layer, if necessary.

The photosensitive layer used for the printing plate of the present invention is preferably in the form of a dispersion of the trisazo pigment, at least one member selected from the perynone pigments and anthanthrone pigments, and the electron donor substance, in an alkali-soluble resin. An organic solvent is used for adjusting the viscosity at the step of forming this dispersion or at the step of coating the dispersion on the electroconductive support. As the organic solvent, there can be mentioned ketones such as acetone and methylethylketone, alcohols such as methanol, ethanol and isopropyl alcohol, aromatic hydrocarbons such as toluene and xylene, cellosolves such as methyl cellosolve, ethyl cellosolve and butyl cellosolve, and acetic acid esters such as methyl acetate and ethyl acetate. At least one member selected from organic solvents having a good compatibility with the alkali-soluble resin and showing a good film-forming property at the coating step is used. The dispersion can be accomplished by agitation alone, but to improve the electrophotographic characteristics and improve the quality of the formed image, preferably a method is adopted in which the respective components are uniformly dispersed by a mechanical means, and in general, a ball mill, a sand mill or the like is used as the mechanical means. As the coating method, there can be adopted a blade coating method, a gravure roll coating method, a rotational coating method, a knife coating method, and a dip coating method.

The electrophotographic photosensitive layer of the printing plate of the present invention is formed by dispersing the trisazo pigment, at least one member selected from the perynone pigments and anthanthrone pigments, and the electron donor substance, in the alkali-soluble resin. This dispersion comprises 1 to 10 parts by weight, preferably 3 to 6 parts by weight, of the trisazo pigment of the above-mentioned general formula, 5 to 30 parts by weight, preferably 10 to 20 parts by weight, of the perynone pigment or anthanthrone pigment, 1 to 30 parts by weight, preferably 5 to 15 parts by weight, of the electron donor substance, and 30 to 100 parts by weight, preferably 50 to 80 parts by weight, of the alkali-soluble resin.

In the printing plate of the present invention, the thickness of the electrophotographic photosensitive layer is 0.5 to 30 μm, preferably 1 to 10 μm.

The printing plate for the electrophotography according to the present invention is formed into a final (printable) printing plate through the following steps. First, as in the usual electrophotographic process, the surface of the photosensitive layer is charged by a charger, and then an electrostatic latent image is formed by a reflection original light exposure using a halogen lamp or a xenon lamp, a transmission original light exposure using a fluorescent lamp, or a scanning light exposure using an He-Ne laser or light-emitting diode light source. This electrostatic latent image is reproduced by a developing agent, and the formed visible toner image is fixed. Thereafter, the printing plate having the electrophotographic image formed thereon is treated with an alkaline aqueous solution or an alcohol solubilizing solution, whereby a non-image area is completely eluted while leaving only the toner image, the support having the hydrophilic surface is exposed, and a final (printable) printing plate is obtained. During this treatment, the toner shows a resistance to the alkaline aqueous solution or alcohol solution, and if an appropriate elutant is selected, usual developing agents for the electrophotography show similar effects. To further improve this resistance, a developing agent comprising a toner component having an alkali resistance and an alcohol resistance can be used. A variety of eluting solutions, for example, alkaline aqueous solutions comprising, as the main component, an inorganic alkali such as sodium silicate, sodium hydroxide, sodium phosphate or sodium carbonate, alkaline solutions comprising, as the main component, an organic amine such as monoethanolamine, diethanolamine or triethanolamine, solutions comprising, as the main component, an alcohol such as ethyl alcohol, isopropyl alcohol or benzyl alcohol, and the like can be appropriately selected and used according to the properties of the binder resin of the photosensitive layer and the constituent resin of the toner.

The present invention will now be described in detail with reference to the following examples, that by no means limit the scope of the invention.

EXAMPLE 1

A mixture comprising 5 parts by weight of a trisazo pigment (exemplified compound A-1), 20 parts by weight of a perynone pigment [represented by formula (IV)], 15 parts by weight of 2,5-bis(4-dimethylaminophenyl)-1,3,4-oxadiazole, 60 parts by weight of an alkali-soluble resin (copolymer of butyl methacrylate and methacrylic acid), and 100 parts by weight of a mixed solvent of methylethylketone and methyl cellosolve was charged in a glass ball mill and rotated for 48 hours on a ball mill stand to form a uniform dispersion. The formed sensitizing liquid was then coated and dried on a sandblasted aluminum sheet by using a wire bar, to form a printing plate having an electrophotographic photosensitive layer having a thickness of 4 μm.

The light decay characteristics and dark decay characteristics of the electrophotographic photosensitive layer of the obtained printing plate were determined by using a paper analyzer (Model SP-428 supplied by Kawaguchi Denki). The measurement conditions adopted were as described below.

For the measurement of the light decay characteristics, the corona charging was carried out under a charging voltage of −6 KV, and the sample was allowed to stand in a dark place for 5 seconds and was exposed to white light in an exposure quantity of 3 luxes by using a tungsten lamp. For the measurement of the dark decay characteristics, the surface voltage $V_0$ just after the corona charging under −6 KV was compared with the surface voltage $V_{60}$ after standing for 60 seconds in the dark place, and the attenuation factor $[1-V_{60}/V_0]$ was determined.

This printing plate was subjected to a plate-making operation using a direct plate-making machine (Model IP-701 supplied by Iwasaki Tsushinki), and a plate image having less development fogging was obtained. The electrophotographic characteristics were as shown in Table 1. Thereafter, the printing plate having the image formed thereon was immersed in an aqueous solution containing 1% by weight of sodium silicate, and the electrophotographic photosensitive layer of the non-image area was washed away by city water while rubbing with a sponge.

The obtained printing plate was set to an offset printing machine, and a printing operation was carried out, and printed images having no contamination were obtained. The printing durability was higher than 30,000 prints.

EXAMPLE 2

The electrophotographic characteristics and printability characteristics were determined in the same manner as described in Example 1, except that a mixture comprising 5 parts by weight of a trisazo pigment (exemplified compound A-1), 20 parts by weight of an anthanthrone pigment [represented by formula (V)], 10 parts by weight of 2,5-bis(4-dimethylaminophenyl)-1,3,4-oxadiazole, 60 parts by weight of an alkali-soluble resin (copolymer of butyl methacrylate and methacrylic acid), and 100 parts by weight of a mixed solvent of methylethylketone and methyl cellosolve was used as the starting mixture. The image formed on the printing plate and the image formed by the printing plate had a high quality, and no fogging or contamination was observed. The printing durability was higher than 30,000 prints, and the electrophotographic characteristics were as shown in Table 1.

EXAMPLE 3

The electrophotographic characteristics and printability characteristics were determined in the same manner as described in Example 1, except that a mixture comprising 7 parts by weight of a trisazo pigment (exemplified compound C-2), 20 parts by weight of an anthanthrone pigment [represented by formula (V)], 10 parts by weight of 2,5-bis(4-dimethylaminophenyl)-1,3,4-oxadiazole, 60 parts by weight of an alkali-soluble resin (copolymer of vinyl acetate and crotonic acid), and 100 parts by weight of a mixed solvent of methylethylketone and methyl cellosolve was used as the starting mixture. The image formed on the printing plate and the image formed by the printing plate and a high quality, and no fogging or contamination was observed. The printing durability was higher than 30,000 prints, and the electrophotographic properties were as shown in Table 1.

EXAMPLE 4

The electrophotographic characteristics and printability characteristics were determined in the same manner as described in Example 1, except that a mixture comprising 7 parts by weight of a trisazo pigment (exemplified compound B-1), 20 parts by weight of a perynone pigment [represented by formula (IV)], 5 parts by weight of 2-methyl-4-dibenzylaminobenzaldehyde-1,1-diphenylhydrazone, 60 parts by weight of an alkali-soluble resin (copolymer of vinyl acetate and crotonic acid), and 100 parts by weight of a mixed solvent of methylethylketone and methyl cellosolve was used as the starting mixture. The image formed on the printing plate and the image formed by the printing plate had a high quality, and no fogging or contamination was observed. The printing durability was higher than 30,000 prints, and the electrophotographic properties were as shown in Table 1.

COMPARATIVE EXAMPLE 1

The electrophotographic characteristics and printability characteristics were determined in the same manner as described in Example 1, except that a mixture comprising 25 parts by weight of a perynone pigment [represented by formula (IV)], 10 parts by weight of 2,5-bis(4-dimethylaminophenyl)-1,3,4-oxadiazole, 60 parts by weight of an alkali-soluble resin (copolymer of butyl methacrylate and methacrylic acid), and 100 parts by weight of a mixed solvent of methylethylketone and methyl cellosolve was used as the starting mixture. In the image formed on the printing plate, conspicuous development fogging was observed, and the elution with the alkaline aqueous solution was incomplete. The electrophotographic characteristics were as shown in Table. 1.

COMPARATIVE EXAMPLE 2

The electrophotographic characteristics and printability characteristics were determined in the same manner as described in Example 1, except that a mixture comprising 25 parts by weight of a trisazo pigment (exemplified compound A-1), 10 parts by weight of 2,5-bis(4-dimethylaminophenyl)-1,3,4-oxadiazole, 60 parts by weight of an alkali-soluble resin (copolymer of butyl methacrylate and methacrylic acid), and 100 parts by weight of a mixed solvent of methylethylketone and methyl cellosolve was used as the starting mixture. In the image formed on the printing plate, conspicuous development fogging as observed, and the elution with the alkaline aqueous solution was incomplete. The electrophotographic characteristics were as shown in Table 1.

COMPARATIVE EXAMPLE 3

The electrophotographic characteristics and printability characteristics were determined in the same manner as described in Example 1, except that a mixture comprising 5 parts by weight of a trisazo pigment (exemplified compound A-1), 20 parts by weight of a perynone pigment [represented by formula (IV)], 60 parts by weight of an alkali-soluble resin (copolymer of butyl methacrylate and methacrylic acid), and 100 parts by weight of a mixed solvent of methylethylketone and methyl cellosolve was used as the starting mixture. In the image formed on the printing plate, conspicuous development fogging was observed, and the elution with the alkaline aqueous solution was incomplete. The electrophotographic characteristics were as shown in Table 1.

TABLE 1

| Example No. | Initial Voltage $V_0$ [V] | Sensitivity $E_{1/2}$ [Lux. Sec] | Dark Attenuation Factor |
|---|---|---|---|
| Example 1 | 410 | 8.1 | 0.27 |
| Example 2 | 408 | 8.7 | 0.26 |
| Example 3 | 380 | 9.1 | 0.27 |
| Example 4 | 405 | 8.3 | 0.20 |
| Comparative Example 1 | 400 | 31 | 0.21 |
| Comparative Example 2 | 315 | 85 | 0.37 |
| Comparative Example 3 | 420 | 80 | 0.22 |

We claim:

1. A printing plate for an electrophotographic process, which printing plate comprises an electroconductive support and a photosensitive layer formed on the electroconductive support, said photosensitive layer comprising an alkali-soluble binder resin and, incorporated therein, (a) a trisazo pigment represented by the following general formula (I):

$$A—N=N—Ar_1—N=N—Ar_2—N=N—A \quad (I)$$

wherein A represents a coupler residue having an aromatic property, and $Ar_1$ and $Ar_2$ each represent a substituted or unsubstituted carbocyclic aromatic ring group, and (b) an anthanthrone pigment as a photoconductive substance represented by the following formula (V):

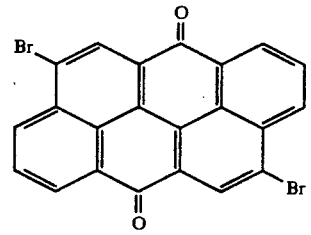

(V)

and (c) at least one electron donor substance as a sensitizer.

2. A printing plate as set forth in claim 1, wherein A in general formula (I) is a coupler residue represented by the following general formula (a):

(a)

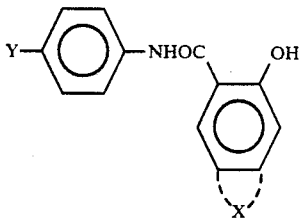

wherein X represents a residue capable of forming a naphthalene ring, an anthracene ring or a carbazole ring by fusion to the benzene ring, and Y is selected from H, Cl and $CH_3$.

3. A printing plate as set forth in claim 1, wherein the trisazo pigment is at least one member selected from the group consisting of compounds represented by the following structural formulae (A-1), (A-2), (A-3), (B-1), (B-2), (B-3), (C-1), (C-2) and (C-3):

(A-1)

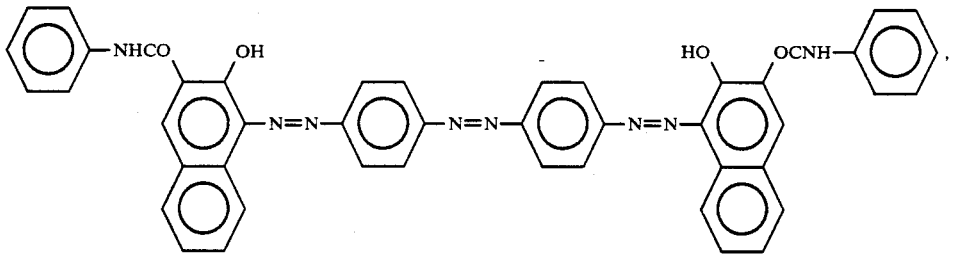

(A-2)

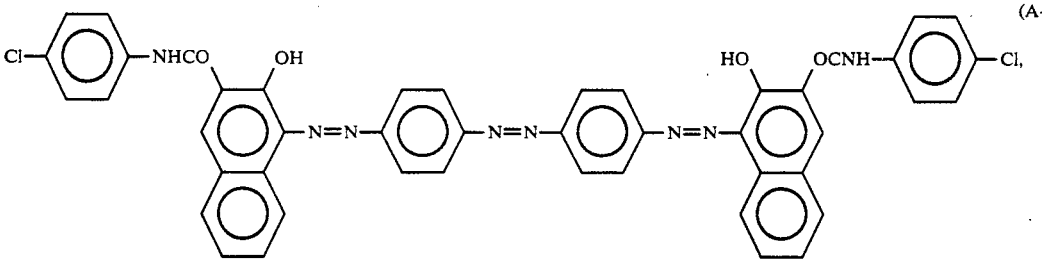

(A-3)

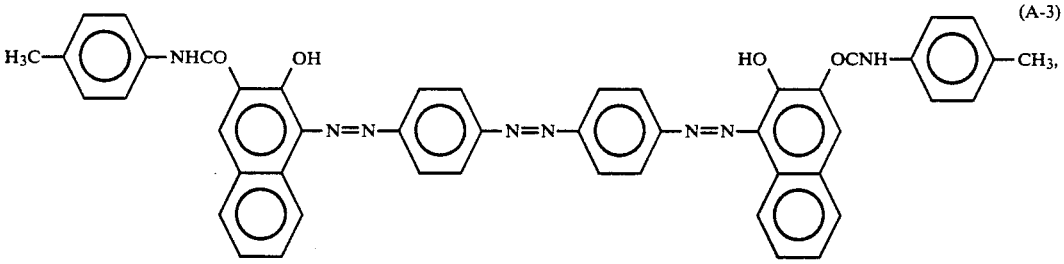

(B-1)

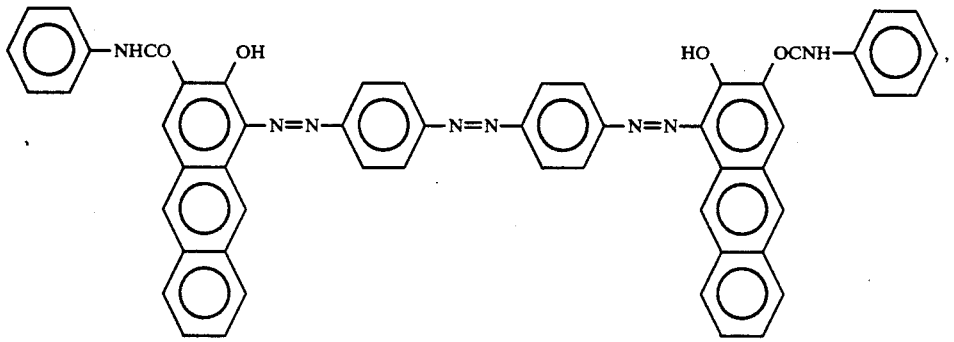

-continued
(B-2)
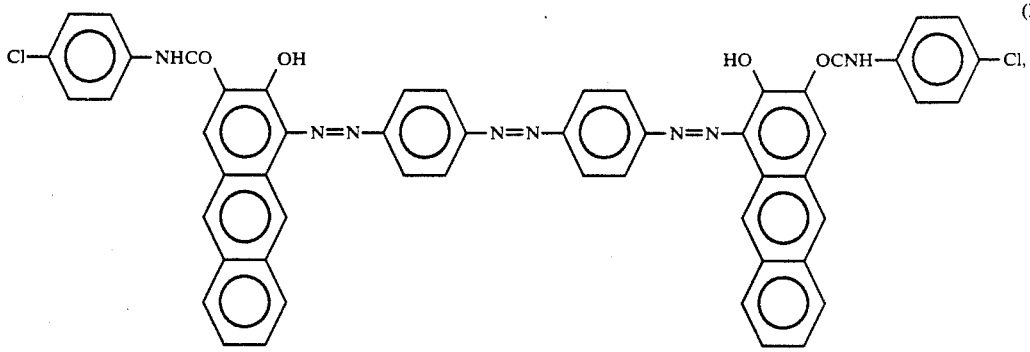
(B-3)
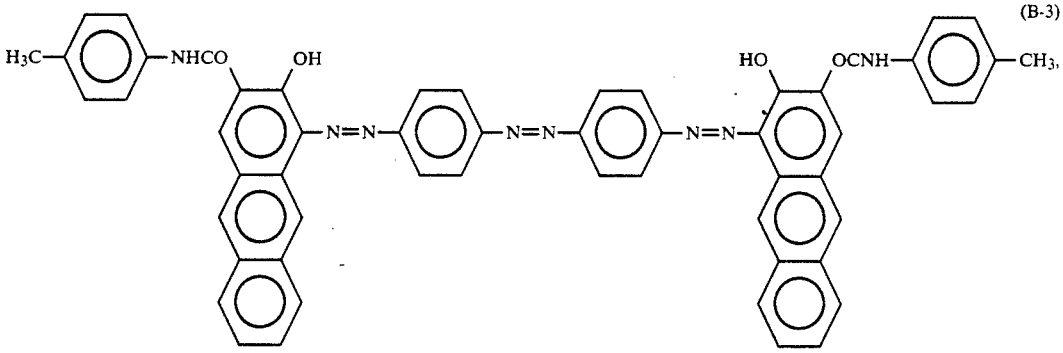
(C-1)
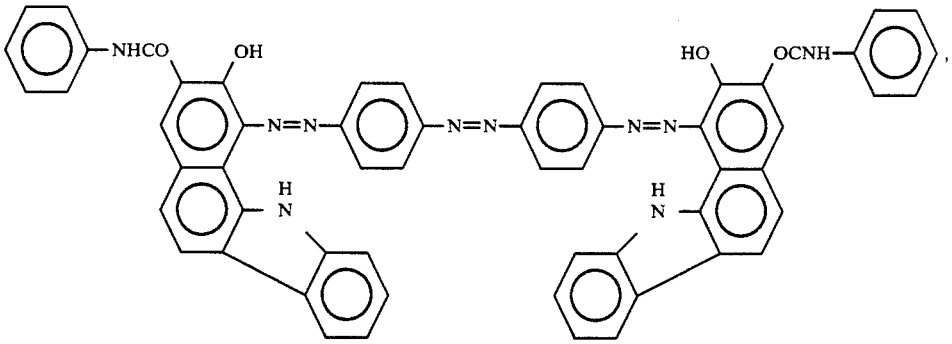
(C-2)
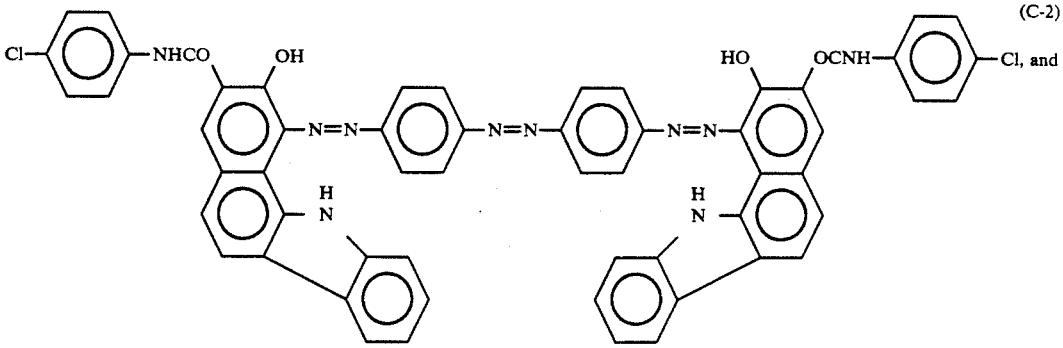

-continued (C-3)

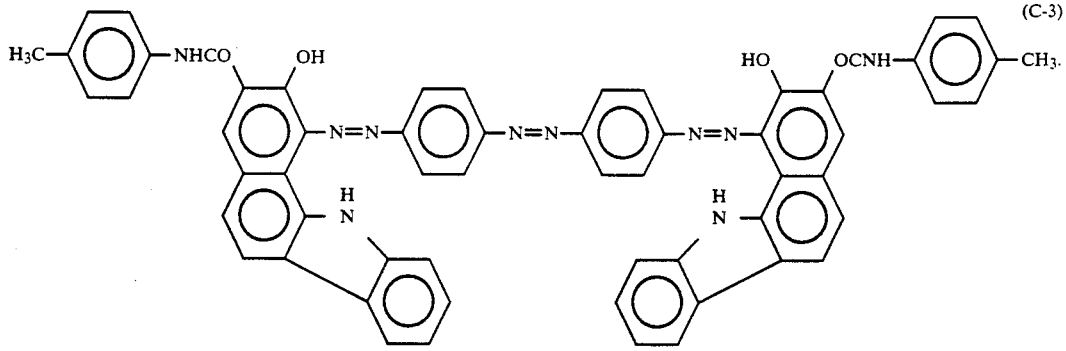

4. A printing plate as set forth in claim 1, wherein the perynone pigment is represented by the following formula (IV):

(IV)

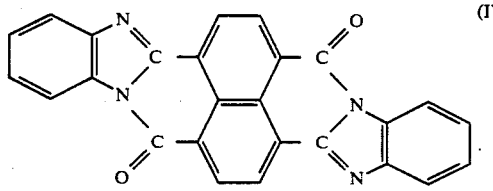

5. A printing plate as set forth in claim 1, wherein the electron donor substance is at least one member selected from the group consisting of oxadiazole compounds, oxazole compounds, triphenylmethane, compounds, hydrazone compounds, dialkylaminobenzoic acids, and polycyclic aromatic compounds.

6. A printing plate as set forth in claim 1, wherein the alkali-soluble binder resin is selected from the group consisting of (1) copolymers of acrylic acid (methacrylic acid) with at least one methacrylic acid ester, (2) copolymers of a vinyl ester with at least one unsaturated carboxylic acid, (3) copolymers of styrene with maleic acid or maleic anhydride, (4) novolak type phenolic resins obtained by condensation reaction of at least one member selected from the group consisting of phenol and substituted phenols with an aldehyde under acidic conditions and (5) mixtures of two or more of the foregoing resins.

7. A printing plate as set forth in claim 1, wherein the photosensitive layer comprises 1 to 10 parts by weight of the trisazo pigment, 5 to 30 parts by weight of the anthanthrone pigment, 1 to 30 parts by weight of the election donor substance and 30 to 100 parts by weight of the alkali-soluble resin.

8. A printing plate as set forth in claim 1, wherein the photosensitive layer comprises 3 to 6 parts by weight of the trisazo pigment, 10 to 30 parts by weight of the anthanthrone pigment, 5 to 15 parts by weight of the electron donor substance and 50 to 80 parts by weight of the alkali-soluble resin.

9. A printing plate for an electrophotographic process, which printing plate comprises an electroconductive support and a photosensitive layer formed on the electroconductive support, said photosensitive layer comprising an alkali-soluble binder resin and, incorporated therein, (a) a trisazo pigment represented by the following general formula (I):

$$A—N=N—Ar_1—N=N—Ar_2—N=N—A \quad (I)$$

wherein A represents a coupler residue having an aromatic property, and $Ar_1$ and $Ar_2$ each represent a substituted or unsubstituted carbocyclic aromatic ring group, and (b) at least one member selected from the group consisting of perynone pigments and anthanthrone pigments as photoconductive substances, and (c) an electron donor substance as a sensitizer represented by the following structural formula (III):

(III)

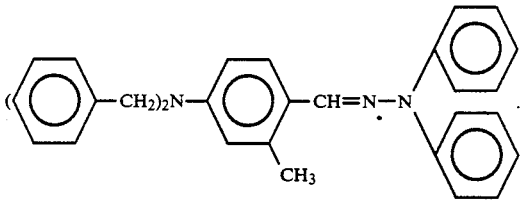

10. A printing plate as set forth in claim 9, wherein A in general formula (I) is a coupler residue represented by the following general formula (a):

(a)

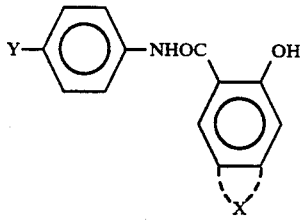

wherein X represents a residue capable of forming a naphthalene ring, and anthracene ring or a carbazole ring by fusion to the benzene ring, and Y is selected from H, Cl and $CH_1$.

11. A printing plate as set forth in claim 9, wherein the trisazo pigment is at least one member selected from the group consisting of compounds represented by the following structural formulae (A-2), (A-3), (B-1), (B-2), (B-3), (C-1), (C-2) and (C-3):

(A-1)
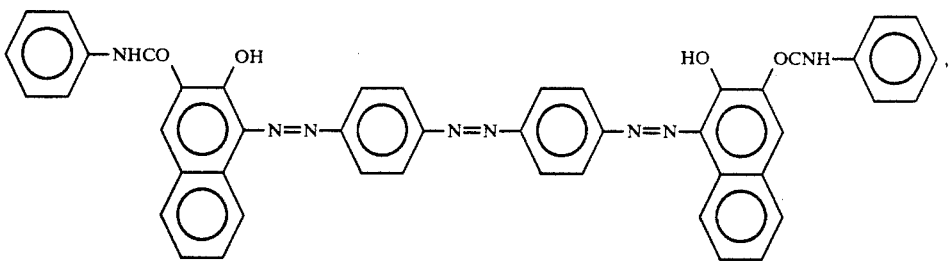
(A-2)
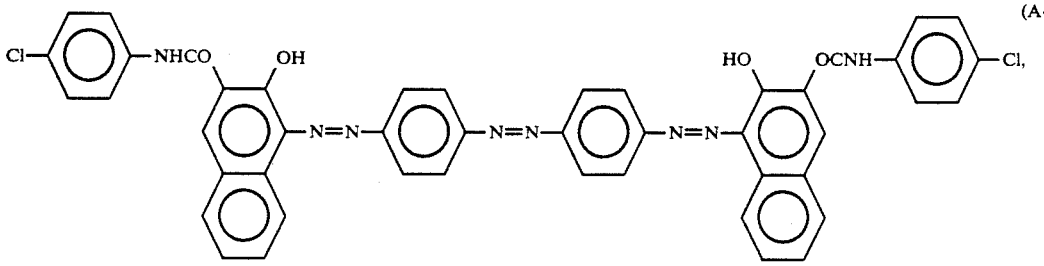
(A-3)
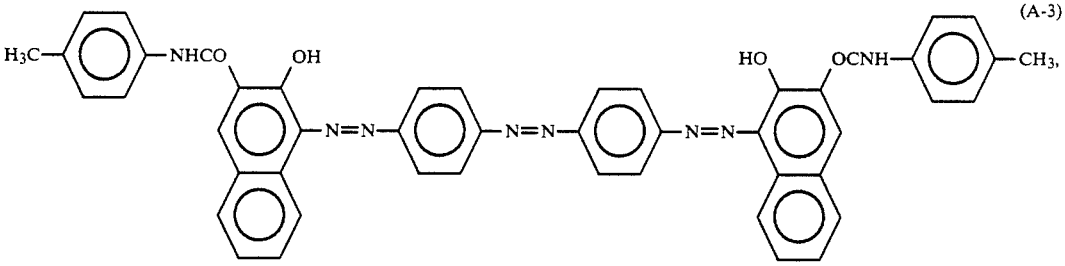
(B-1)
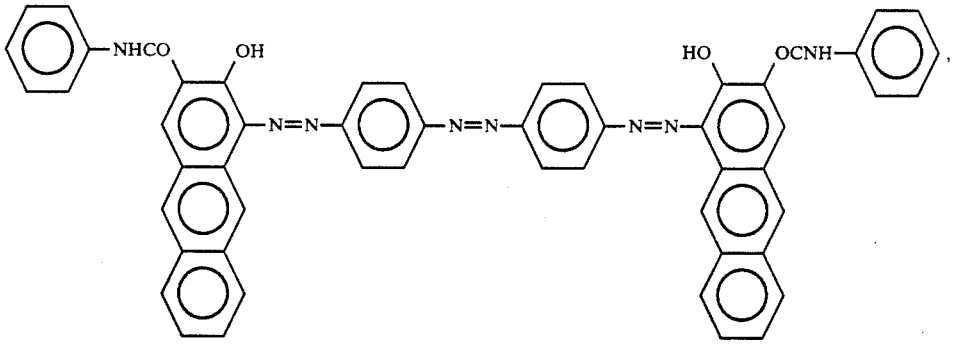
(B-2)
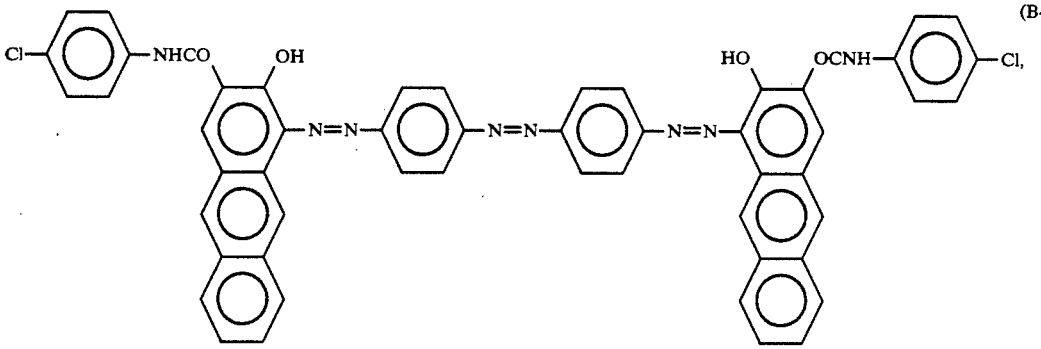

-continued
(B-3)
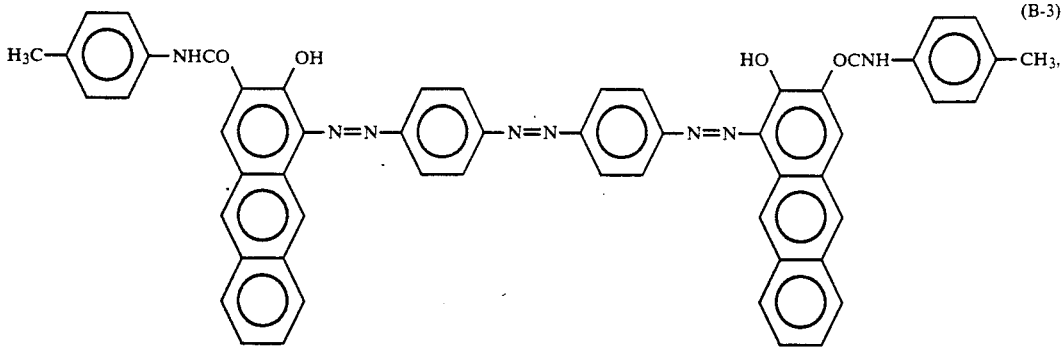
(C-1)
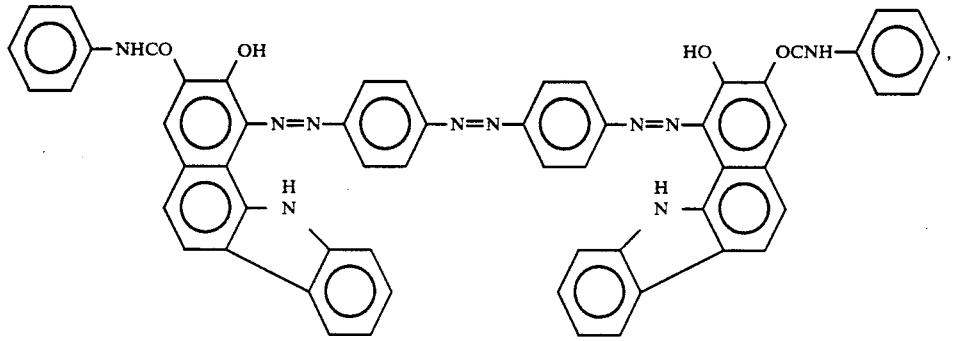
(C-2)
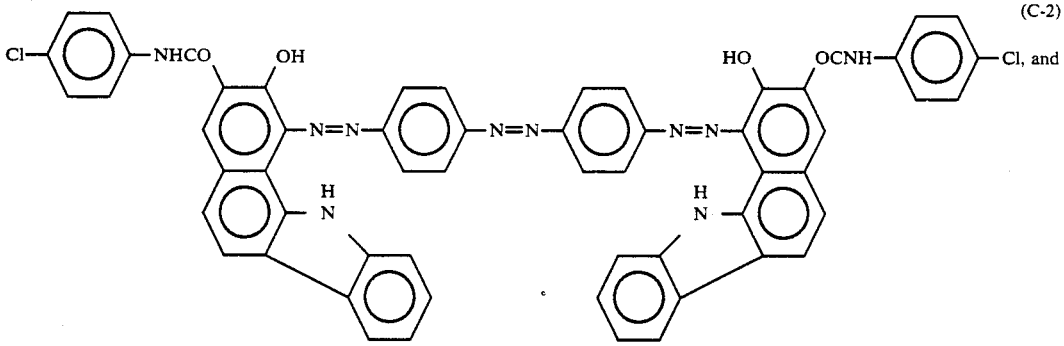
(C-3)
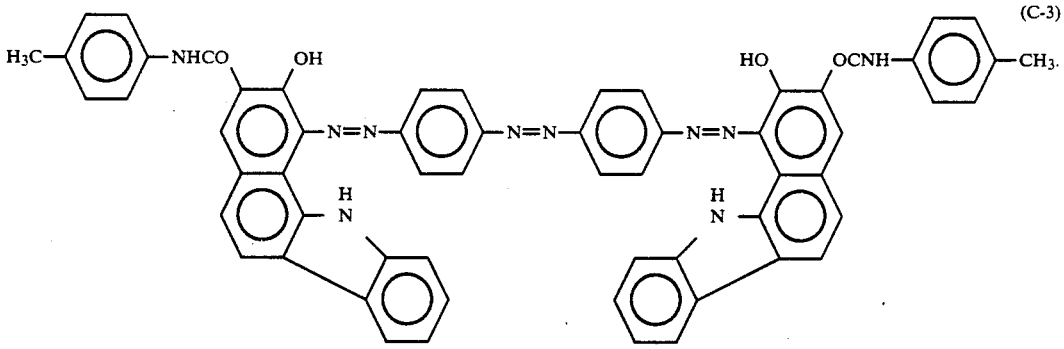
(IV)
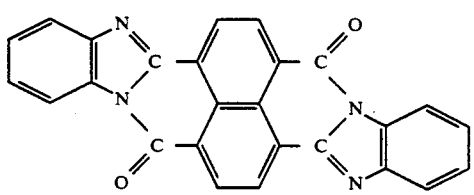
12. A printing plate as set forth in claim 9, wherein the perynone pigment is represented by the following formula (IV):

13. A printing plate as set forth in claim 9, wherein the alkali-soluble binder resin is selected from the group consisting of (1) copolymers of acrylic acid (methacrylic acid) with at least one methacrylic acid ester, (2) copolymers of a vinyl ester with at least one unsaturated carboxylic acid, (3) copolymers of styrene with maleic acid or maleic anhydride, (4) novolak type phenolic resins obtained by condensation reaction of at least one member selected from the group consisting of phenol and substituted phenols with an aldehyde under acidic conditions and (5) mixtures of two or more of the foregoing resins.

14. A printing plate as set forth in claim 9, wherein the photosensitive layer comprises 1 to 10 parts by weight of the trisazo pigment, 5 to 30 parts by weight of at least one member selected from the perynone pigments and anthanthrone pigments, 1 to 30 parts by weight of the electron donor substance and 30 to 100 parts by weight of the alkali-soluble resin.

15. A printing plate as set forth in claim 9, wherein the photosensitive layer comprises 3 to 6 parts by weight of the trisazo pigment, 10 to 20 parts by weight of at least one member selected from the perynone pigments and anthanthrone pigments, 5 to 15 parts by weight of the electron donor substance and 50 to 80 parts by weight of the alkali-soluble resin.

* * * * *